US010293349B2

(12) United States Patent
Pahl et al.

(10) Patent No.: US 10,293,349 B2
(45) Date of Patent: May 21, 2019

(54) ROTARY MODULE

(75) Inventors: Andreas Pahl, Erkrath (DE); Alan Pindrock, Hendersonville, TN (US); Benoit Piednoel, Boncourt (FR); Maurice Meziere, Gressey (FR)

(73) Assignee: ITW DYNATEC GMBH, Mettmann (DE)

( * ) Notice: Subject to any disclaimer, the term of this patent is extended or adjusted under 35 U.S.C. 154(b) by 163 days.

(21) Appl. No.: 14/342,750

(22) PCT Filed: Sep. 11, 2012

(86) PCT No.: PCT/IB2012/054723

§ 371 (c)(1),
(2), (4) Date: Jan. 8, 2015

(87) PCT Pub. No.: WO2013/038338

PCT Pub. Date: Mar. 21, 2013

(65) Prior Publication Data

US 2015/0190821 A1 Jul. 9, 2015

(30) Foreign Application Priority Data

Sep. 12, 2011 (DE) ..... 10 2011 112 846
Jul. 27, 2012 (DE) ..... 20 2012 007 235 U
Aug. 30, 2012 (DE) ..... 20 2012 008 272 U

(51) Int. Cl.
*B05C 5/00* (2006.01)
*B05B 7/06* (2006.01)
(Continued)

(52) U.S. Cl.
CPC ..... *B05B 3/026* (2013.01); *B05B 13/0278* (2013.01); *B05B 15/066* (2013.01); *B05B 15/08* (2013.01); *B05C 5/0279* (2013.01)

(58) Field of Classification Search
USPC ..... 118/300, 313–315, 325, 410, 321, 323; 156/578
See application file for complete search history.

(56) References Cited

U.S. PATENT DOCUMENTS 3,570,725 A 3/1971 Baker et al.
RE27,865 E * 1/1974 Baker et al. ..... B05C 5/0275 118/315
(Continued)

FOREIGN PATENT DOCUMENTS

CN 1232414 A 10/1999
DE 29809480 U1 10/1999
(Continued)

OTHER PUBLICATIONS

International Search Report and the Written Opinion filed in connection with PCT/IB2012/054723 dated Dec. 20, 2012.
(Continued)

*Primary Examiner* — Yewebdar T Tadesse
(74) *Attorney, Agent, or Firm* — Levenfeld Pearlstein, LLC

(57) ABSTRACT

A device (10) for applying a fluid to a moving substrate (36) includes a nozzle head (15*a*, 15*b*, 15*c*, 15*d*) with an inlet opening (26, 26*c*) and an outlet opening (29*a*, 29*b*, 29*c*, 29*d*). The device further includes a supply station (11) with a fastening surface (17) with a mouth region (20*a*) of a fluid duct. The nozzle head is arranged so as to be pivotable relative to the fastening surface about a pivot axis (38*a*). The inlet opening (26, 26*c*) and the mouth region (20*a*) of the fluid duct are arranged in alignment along the pivot axis (38*a*).

16 Claims, 11 Drawing Sheets

(51) Int. Cl.

| | |
|---|---|
| ***B05B 3/02*** | (2006.01) |
| ***B05B 13/02*** | (2006.01) |
| ***B05B 15/06*** | (2006.01) |
| ***B05B 15/08*** | (2006.01) |
| ***B05C 5/02*** | (2006.01) |

(56) References Cited

U.S. PATENT DOCUMENTS

| | | | | |
|---|---|---|---|---|
| 4,479,610 | A | 10/1984 | Etheridge | |
| 4,969,602 | A * | 11/1990 | Scholl | B05B 7/0861 239/135 |
| 5,238,190 | A | 8/1993 | Herke | |
| 5,265,800 | A | 11/1993 | Ziecker et al. | |
| 5,683,037 | A | 11/1997 | Rochman | |
| 5,823,437 | A * | 10/1998 | Bolyard, Jr. | B05B 7/164 239/124 |
| 5,862,986 | A * | 1/1999 | Bolyard, Jr. | B05B 7/164 137/115.13 |
| 5,887,757 | A | 3/1999 | Jenkins et al. | |
| 6,165,266 | A | 12/2000 | Garcia | |
| 6,883,735 | B2 | 4/2005 | Ganzer | |
| 2003/0098317 | A1 * | 5/2003 | McGuffey | B05C 5/0279 222/136 |

FOREIGN PATENT DOCUMENTS

| | | | |
|---|---|---|---|
| EP | 1442798 | A2 | 8/2004 |
| JP | S6083085 | A | 5/1985 |
| JP | 5284562 | B2 | 9/2013 |
| WO | 2004037445 | A3 | 6/2004 |
| WO | 2008060935 | A2 | 5/2008 |

OTHER PUBLICATIONS

European Search Report issued by ISA in connection with EP 12 783 295.4 dated Jun. 27, 2017.

* cited by examiner

ROTARY MODULE

CROSS-REFERENCE TO RELATED APPLICATIONS

This is a National Stage Application of International Patent Application No. PCT/IB2012/054723, filed Sep. 11, 2012, which claims priority to German Patent Application No. 10 2011 112 846.1, filed on Sep. 12, 2011, German Patent Application No. 20 2012 007 235.8, filed on Jul. 27, 2012, and German Patent Application No. 20 2012 008 272.8, filed on Aug. 30, 2012, the contents of each application above incorporated fully by reference herein.

BACKGROUND

The invention relates firstly to a device for applying a fluid, such as an adhesive or lotion, to a moving substrate.

Such devices have been developed and marketed by the applicant for some time.

During the application of a fluid to a substrate, in particular to a moving substrate moving past the device, it is desirable to be able to change the fluid application pattern as a function of different substrates and different uses. There is thus a demand to be able to make the deposition pattern flexible. For this purpose, it is already known for a nozzle head to be formed so as to be pivotable relative to a fastening surface of a supply station.

SUMMARY

Taking as a starting point the device which has become known through prior public use, it is the object of the invention to further develop the known device in such a way that optimized sealing is made possible with a simple and compact design.

The invention achieves said object by means of a device for applying a fluid, such as adhesive or lotion, to a moving substrate, comprising a nozzle head with an inlet opening for the fluid and with an outlet opening for the fluid and comprising a supply station with a fastening surface with a mouth region of a fluid duct, the nozzle head being arranged so as to be pivotable relative to the fastening surface about a pivot axis, wherein the inlet opening for the fluid and the mouth region of the fluid duct are arranged in alignment along the pivot axis.

The principle of the invention consists substantially in that, in a device for applying a fluid, the nozzle head is arranged so as to be pivotable relative to the fastening surface in a particular way. The pivot axis is positioned and oriented so as to connect the inlet opening for the fluid on the nozzle head and the mouth of the fluid duct on the fastening surface to one another. The inlet opening for the fluid on the nozzle head and the mouth of the fluid duct on the fastening surface are arranged in alignment, specifically along the pivot axis.

Said particular positioning and arrangement of the inlet opening and mouth region is configured such that the pivot axis for the pivoting of the nozzle head runs through said two regions. This permits particularly simple and reliable sealing of the fluid duct, because in the region of the sealing surfaces, the movements which occur during a pivoting movement, in particular ranges of relative movement, are minimized.

The device according to the invention for applying a fluid serves in particular for applying a hot melt adhesive to a substrate. For this purpose, warm, liquid adhesive is supplied from a supply station to the nozzle head through the fluid duct, if appropriate via an adapter plate. For this purpose, the nozzle head has an inlet opening for the fluid on its side facing toward the supply station. The fluid passes from the inlet opening via a switchable valve to an outlet opening for the fluid on the nozzle head. The fluid can be discharged, and arrive at the substrate, through the outlet opening.

The switchable valve which is arranged in the nozzle head is switched by means of a flow fluid, in particular compressed air. For this purpose, the supply station has a first flow fluid duct and a second flow fluid duct which both open out in the region of the fastening surface. The first flow fluid provides so-called activation air and the second flow fluid duct provides so-called deactivation air. By means of the activation air, the valve on the nozzle head is opened, such that the fluid can emerge through the outlet opening. By means of the deactivation air, the valve is closed, such that an emergence of the fluid through the outlet opening is prevented. The first flow fluid duct and the second flow fluid duct are in communicative connection with inlet openings for the first and the second flow fluid on that side of the nozzle head which faces toward the supply station.

In pivotable modules of the prior art, particular problems are encountered with regard to the sealing of the fluid duct.

According to the invention, the inlet opening for the fluid on the nozzle head, on that side of the nozzle head which faces toward the supply station, and the mouth of the fluid duct on the fastening surface are arranged in alignment along the pivot axis. The pivot axis is in other words positioned so as to be arranged approximately in the center of the inlet opening for the fluid or approximately in the center of the mouth region of the fluid duct.

Around the inlet opening for the fluid there may be arranged an annular groove which serves for receiving a sealing ring, for example an O ring. Particularly simple sealing is possible in this way.

With regard to the structural design, it is pointed out that the device may comprise an adapter plate which can be fixedly screwed to the fastening surface. The adapter plate may have a groove into which a slide block is inserted. A fastening of the nozzle head is realized by means of a screw connection to the slide block.

The slide block is displaceably guided in a circular-arc-shaped guide slot, wherein the central point of the circular arc coincides with the pivot axis of the nozzle head. The guide slot is thus curved in the shape of a circular arc around the pivot axis.

The inlet opening for the first flow fluid and the inlet opening for the second flow fluid on that side of the nozzle head which faces toward the supply side are likewise curved in the shape of an arc around the axis of rotation.

The nozzle head is pivotable through an angle range between two stop positions. The two stop positions of the nozzle head correspond to different stop situations of the slide block within the guide slot.

By pivoting the nozzle head, the orientation of the nozzle head in relation to the substrate and thus the angle at which the fluid impinges on the substrate can be adjusted in a simple manner. The sealing of the fluid duct can be particularly reliably maintained because the relative movements of moving parts, and the friction forces thus generated in the region of the sealing surfaces, are minimized.

In a second aspect, the invention relates to a device for applying a fluid, such as an adhesive or lotion, to a moving substrate.

The invention is likewise based on the object of further developing the known device in such a way as to permit a simple and compact construction.

The invention achieves said object by means of a device for applying a fluid, such as adhesive or lotion, to a moving substrate, comprising a nozzle head with an outlet opening for the fluid and comprising a supply station with a fastening surface and with a mouth region of a fluid duct arranged on the fastening surface, the nozzle head being arranged so as to be pivotable relative to the fastening surface about a pivot axis, wherein the nozzle head is fastened to the fastening surface with the aid of an adapter plate, a circular-arc-shaped groove extending through the adapter plate, the pivot axis running through the central point of the circle.

The principle of the invention consists in that the nozzle head is fixed to the fastening surface not directly but rather via or with the aid of an adapter plate. The adapter plate may be fixedly screwed directly to the fastening surface. The nozzle head is fastened to a slide block which is guided in the groove. The adapter plate has a fluid duct which is arranged in alignment with the mouth of the fluid duct on the fastening surface and which is arranged in alignment with the inlet for the fluid on the nozzle head. The adapter plate has preferably a first flow fluid duct and more preferably a second flow fluid duct. The first flow fluid duct is arranged in alignment with a first mouth region of the first flow fluid duct on the fastening surface, and the second flow fluid duct in the adapter plate is arranged in alignment with a second mouth region of a second flow fluid duct on the fastening surface.

A slide block is advantageously inserted in the groove. The arrangement of a groove and of a slide block guided therein permits, with a compact design of the device, a limitation of the pivot movement of the nozzle head in both directions of rotation and reliable guidance and mounting of the pivotable nozzle head relative to the adapter plate.

It may also advantageously be provided that the slide block has a dumbbell-like basic shape. This permits particularly good guidance and mounting.

In one advantageous refinement of the invention, the slide block has screw receptacles on its side facing toward the nozzle head. These permit particularly simple fixing of the nozzle head to the adapter plate.

It may furthermore be provided that the groove has a retention surface against which the slide block can be clamped. The retention surface may be a constituent part of a constriction of the guide slot which is arranged on that side of the guide slot which faces toward the nozzle head. The retention surface may be arranged on that side of the constriction which faces toward the fastening surface. In this way, the slide block can be inserted into the guide slot only from that side of the adapter plate which faces toward the fastening surface, but is prevented by the retention surface from emerging from the adapter plate in the direction of the nozzle head.

In one advantageous refinement of the invention, the nozzle head comprises two components. Here, an outlet opening for the fluid on the nozzle head may be provided by a first component, and an inlet opening for the fluid on the nozzle head may be provided by a second component.

Said design makes it possible for the inlet side of the nozzle head, that is to say that side of the nozzle head which faces toward the fastening surface and on which the circular-arc-shaped inlet openings for the fluid and the inlet openings for the first and the second flow fluid are arranged, to be provided by a first component, and for the inlet side of the first component, which inlet side faces toward the outlet side of the second component, to be designed and dimensioned as is known in the case of conventional nozzle heads. In said refinement of the invention, it is consequently possible for the second component to provide a type of fastening plate which makes it possible to use conventional nozzle heads which have hitherto not been provided for use in a device according to the invention, or alternatively it is possible to design nozzle heads which are configured for a system according to the invention and which may optionally also be used for other, conventional systems which do not conform to the invention.

The second component may be of substantially plate-like form and have inlet openings, which are in particular curved in the shape of a circular arc around the pivot axis, for the first flow fluid and for the second flow fluid. Furthermore, the corresponding grooves for receiving sealing rings may be arranged on the inlet side of the second component.

On the outlet or exit side of the second component, an arrangement of the corresponding fluid and flow fluid mouth regions may be provided such as is known in the case of conventional fastening surfaces of supply stations. In this way, the second component can cooperate with a first component which has an inlet side on which the inlets for the fluid and the two flow fluids are arranged and dimensioned as is known in the prior art for the arrangement of conventional nozzle heads on conventionally-designed fastening surfaces of supply stations.

In one advantageous refinement of the invention, the two components can be detachably fastened to one another, or alternatively the second component can be detachably mounted on the first component. To facilitate the mounting movement or to facilitate a fastening of the two components to one another, coding means and counterpart coding means or alternatively positioning means and counterpart positioning means may be provided on the components. Said means serve to ensure reliable and unequivocal positioning of the components relative to one another.

According to a further aspect, the invention relates to a nozzle head for a device for applying a fluid to a moving substrate. Within the context of the inventions described above, it is proposed that a nozzle head be mounted on a supply station so as to be pivotable relative to a fastening surface about a pivot axis. The pivot axis accordingly advantageously runs through the inlet opening for the fluid.

If the nozzle head comprises two components, specifically a first component in the form of a substantially conventional nozzle head and a second component in the form of an adapter plate, it is necessary to ensure that the nozzle head is connected in a rotationally conjoint manner to said adapter plate.

It is thus the object of the present invention to further develop a known, conventional nozzle head such that, for a situation in which it is mounted so as to be pivotable jointly with an adapter plate relative to a fastening surface of a supply station, said nozzle head, with a structurally simple design, ensuring a rotationally conjoint arrangement of the nozzle head relative to said adapter plate.

The invention achieves said objects by means of a nozzle head for a device for applying a fluid, such as adhesive or lotion to a moving substrate, the nozzle head having an inlet side on which there are arranged an inlet for the fluid, an inlet for a first flow fluid, and an inlet for a second flow fluid, wherein the inlet side has two recesses which are arranged close to the inlet for the second flow fluid and remote from the inlet for the fluid.

The principle of the invention consists substantially in providing two recesses on the inlet side of the nozzle head.

The recesses are formed in particular as female parts. They serve for receiving male projections on the adapter plate.

The female recesses may be of complementary or substantially complementary form to the male projections. It is expedient for the male projections on the outlet side of the adapter plate, which will also be referred to later in the description of the figures as second component 47*c*, to be of substantially cuboidal form. This permits very simple production of the projections.

The female recesses on the inlet side of the nozzle head are advantageously dimensioned such that they can completely receive the male projections. The female recesses are advantageously formed so as to be larger than the male projections. This, in a simple manner, allows the female recesses to be milled out of the nozzle head during the course of manufacturing. If said projection method is selected, it may advantageously be provided that the inner flanks of the recesses are of concavely curved form.

According to the invention, the recesses are arranged close to the inlet for the second flow fluid and remote from the inlet for the fluid. The female recesses have, on their inner side in each case, at least one stop surface or a contact surface which can make contact with the complementary male projection. This allows the adapter plate to be driven during a pivoting movement of the nozzle head. When the nozzle head is moved, pivotable driving or rotary driving in both directions of rotation is reliably ensured.

The recesses are preferably arranged so as to flank the inlet for the second flow fluid at both sides. The inlet for the second flow fluid is thus situated preferably centrally or substantially centrally between the two recesses.

It is furthermore advantageous for the two recesses to be situated as far remote as possible from the inlet opening for the fluid. In this way, a particularly expedient geometry for rotational locking between the nozzle head and adapter plate in both rotational directions is obtained. The recesses engage over the projections—when the nozzle head is mounted on the projections—in such a way that the adapter plate is rotationally driven when a rotation about the pivot axis takes place as a result of a manual exertion of force on the nozzle head.

Further advantages of the invention will emerge from the subclaims, which are not cited, and from the following description of the exemplary embodiment illustrated in the drawings.

DETAILED DESCRIPTION

Before the following description of the exemplary embodiment illustrated in the figures, it is pointed out that, for clarity, identical or similar parts or elements are denoted by the same reference symbols, in some cases with the addition of lowercase alphabetic characters.

Figure 1:
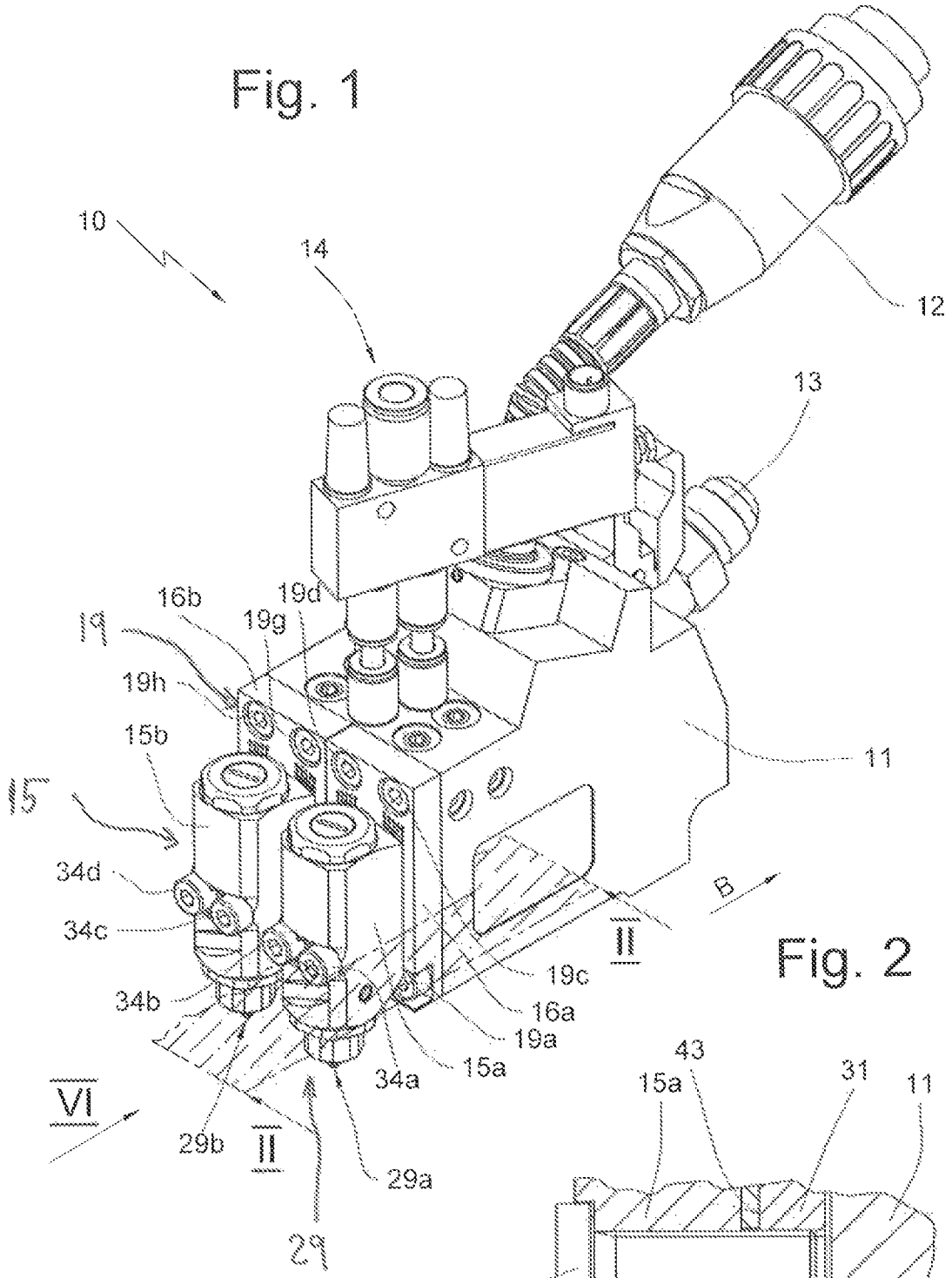
FIG. 1 shows a perspective schematic view of an exemplary embodiment of the device according to the invention with a supply station, two adapter plates and two nozzle heads fastened to the adapter plates.
Figure 3:
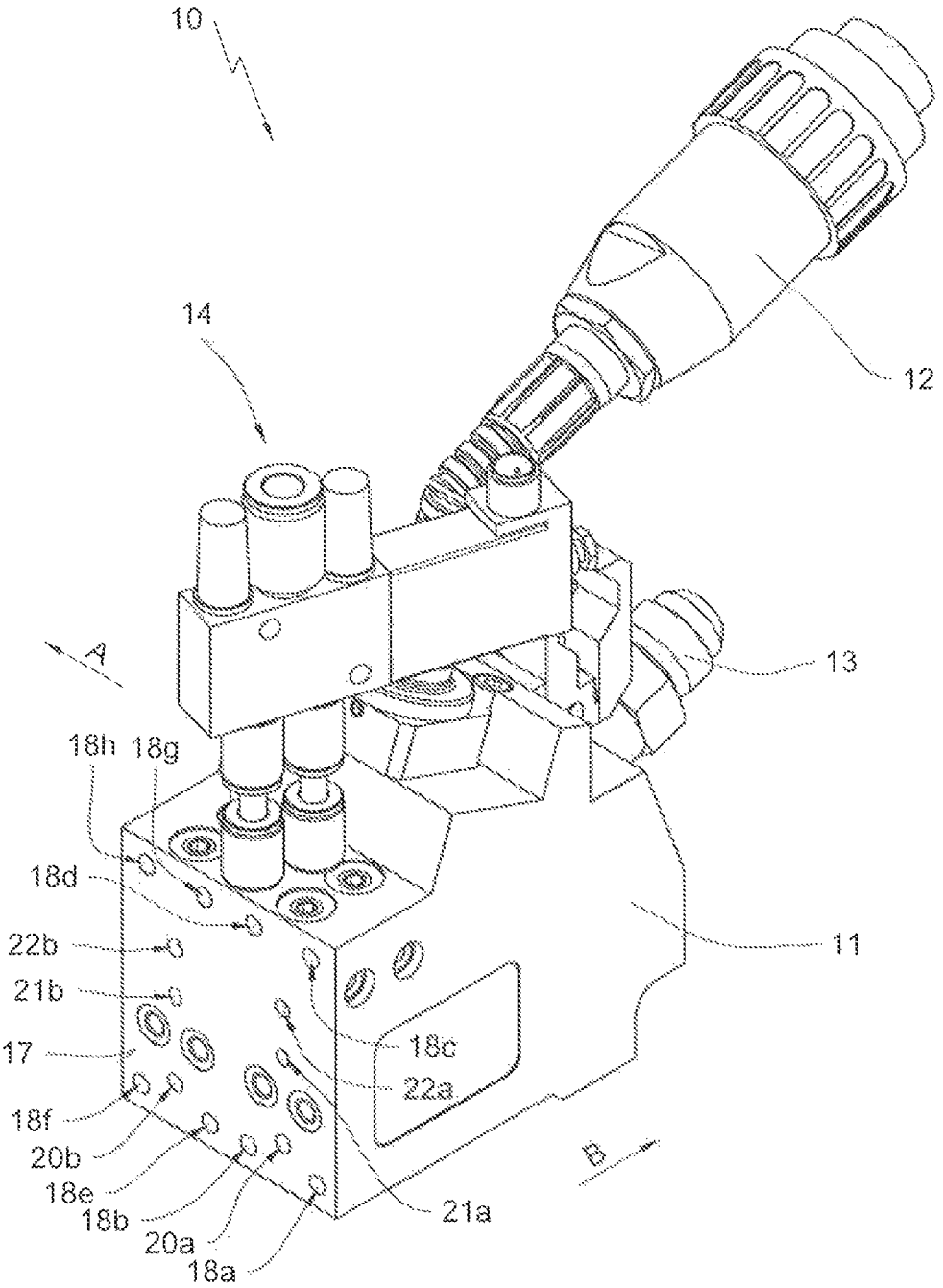
FIG. 3 shows the device according to FIG. 1 in an illustration according to FIG. 1, with the adapter plates and the nozzle heads omitted.

The device shall firstly be explained on the basis of FIGS. 1 and 3:

FIG. 1 shows the device 10 according to the invention in a cut-away, schematic perspective illustration. It is possible to see a supply station 11 which is of substantially block-like form. A cut-away connecting line 12 which connects the supply station 11 to an adhesive reservoir is indicated. Also visible, in a cut-away illustration, is a connection 13 which can connect the supply station 11 via electrical lines to a central controller for the actuation of electrical switches or the like. Also illustrated is a connection 14 by means of which compressed air can be supplied to the supply station 11.

To the supply station 11 there is fastened a first nozzle head 15*a* and a second nozzle head 15*b*. The fastening of the nozzle heads 15*a*, 15*b* to the supply station 11 is realized via a first adapter plate 16*a* and a second adapter plate 16*b* respectively.

FIG. 3 shows the supply station 11 in a state with the nozzle heads 15*a*, 15*b* removed and adapter plates 16*a* and 16*b* removed. It is possible to see the fastening surface 17, which is aligned along a plane.

It is pointed out already at this juncture that a plurality of supply stations 11 may for example be positioned adjacent to one another along the arrangement direction A and if appropriate also fastened to one another. The number of supply stations 11 or also the number of nozzle heads 15 arranged along a row is substantially dependent on the deposition width (that is to say the width of the fluid deposition pattern on the substrate) and on the properties of the substrate. The number of two nozzle heads 15*a*, 15*b* shown in the exemplary embodiment is to be understood merely as an example.

Figure 6:
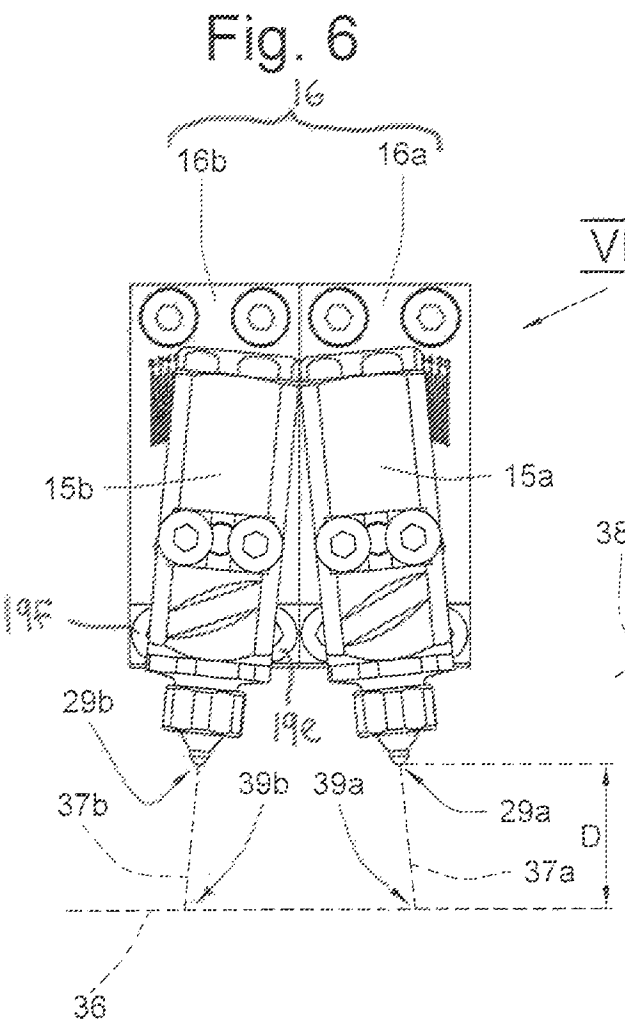
FIG. 6 shows the device of FIG. 1 in a view from the front as per the view arrow VI in FIG. 1, wherein only the nozzle heads and the adapter plates are shown.
Figure 11:
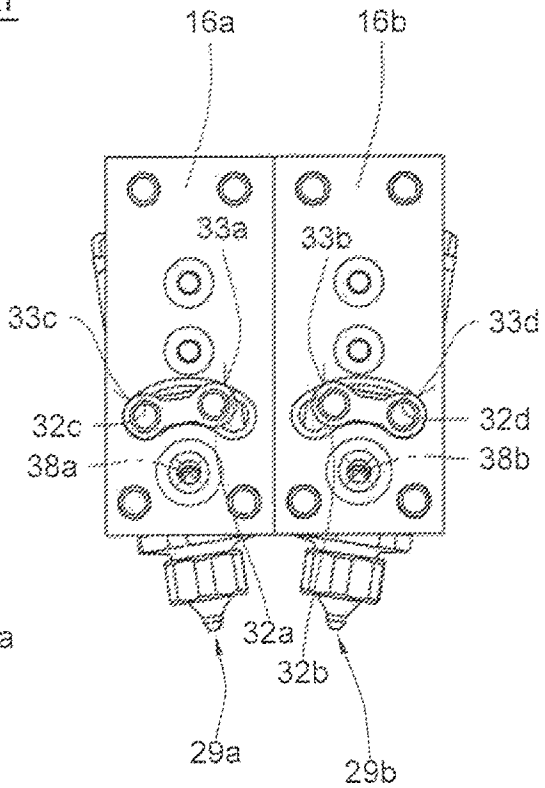
FIG. 11 shows the view from the rear of the arrangement of nozzle heads and adapter plates as per the view arrow XI in FIG. 10.
Figure 10:
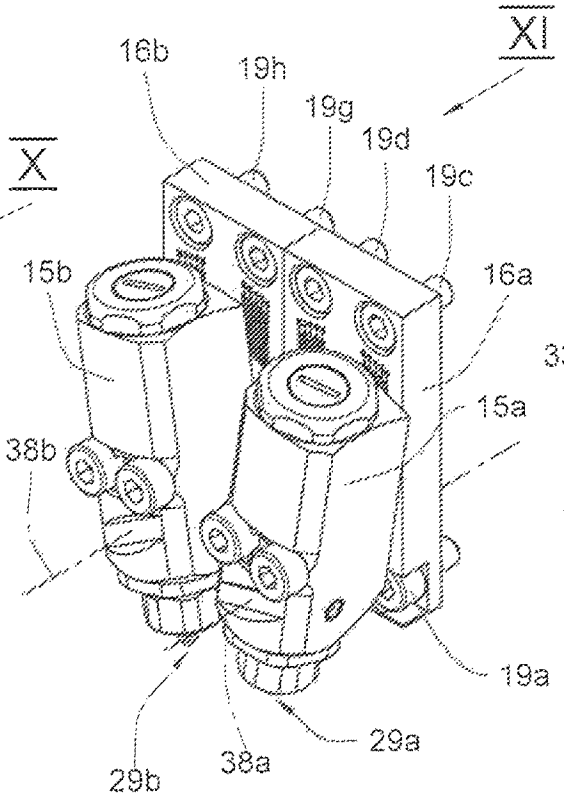
FIG. 10 shows the arrangement of nozzle heads and adapter plates as per the view arrow X in FIG. 9 in an illustration as per FIG. 7.
Figure 9:
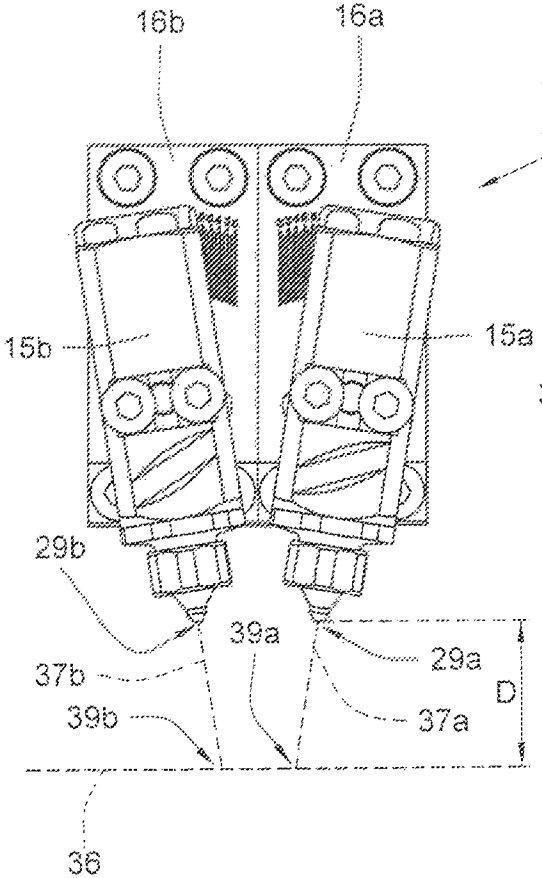
FIG. 9 shows the nozzle heads and adapter plates of FIG. 6 with the nozzle heads in a different pivot position.

Furthermore, for viewer information, it is pointed out that a substrate 36, for example a moving substrate, which is not illustrated in FIG. 1 but which is indicated in FIGS. 6 and 9, can move relative to the device 10, for example below the device 10 in the illustration of FIG. 1, along a movement direction B.

Each nozzle head 15, 15*a*, 15*b* has an outlet opening or an outlet 29, 29*a*, 29*b* for a fluid. In the exemplary embodiment, it should be assumed that the fluid is a hot melt adhesive which is to be applied to a substrate 36 indicated in FIGS. 6 and 9. The substrate 36, which is for example in the form of a web, may for example be moved along at a distance D below the outlet opening 29*a*, 29*b* by means of a drive (not illustrated).

Assuming that an adhesive jet 37*a*, 37*b* (FIG. 6) or a corresponding adhesive thread or a succession of adhesive droplets or the like is dispensed from each outlet opening 29*a*; 29*b*, it is possible, by means of a rotation of the nozzle head 15, 15*a*, 15*b* about the respective pivot axis 38*a*, 38*b*, for a position adjustment of the corresponding nozzle head 15, 15*a*, 15*b* to be performed. In this way, it is possible to attain a changed position of the outlet opening 29, 29*a*, 29*b* relative to the substrate 36, and as a result, a change in the fluid deposition pattern on the substrate 36.

The two extreme positions of the nozzle heads 15*a*, 15*b* are illustrated in FIG. 6 and FIG. 9. In FIG. 6, the two adhesive impingement regions on the substrate 36, denoted by 39*a* and 39*b*, are at a maximum distance from one another, whereas in FIG. 9, the regions 39*a*, 39*b* have been moved toward one another to a maximum extent.

It is self-evidently clear to a person skilled in the art that parallel pivoting of two modules, and an adjustment of the modules independently of one another, may also be performed.

Referring to FIG. 3, it will now be explained that a number of receptacles 18*a*, 18*b*, 18*c*, 18*d*, 18*e*, 18*f*, 18*g*, 18*h*, in particular threaded bores, for receiving fastening elements, preferably screws 19*a*, 19*b*, 19*c*, 19*d*, 19*e*, 19*f*, 19*g*, 19*h* are provided on the fastening surface 17. From a comparison of FIGS. 1 and 3, it is clear to a person skilled in the art that each adapter plate 16, 16*a*, 16*b* has in each case four screw passages which are arranged in each case in the corner regions. Each adapter plate 16, for example the adapter plate 16*a*, is thus fixedly screwed to the fastening surface 17 by means of four screws, for example the screws 19*a*, 19*b*, 19*c*, 19*d*.

On the fastening surface 17 there is furthermore arranged a mouth 20*a* of a fluid duct. Also situated in the fastening surface 17 are a mouth 21*a* of a duct for a first flow fluid and a mouth 22*a* of a duct for a second flow fluid. The three mouths 20*a*, 21*a*, 22*a* or mouth regions 20*a*, 21*a*, 22*a* are arranged along a straight line. Similarly, the fastening surface 17 may also include a mouth 20*b* of a second fluid duct, a mouth 21*b* of a second duct for a first fluid flow and a mouth 22*b* of a second duct for a second fluid flow.

Figure 5:
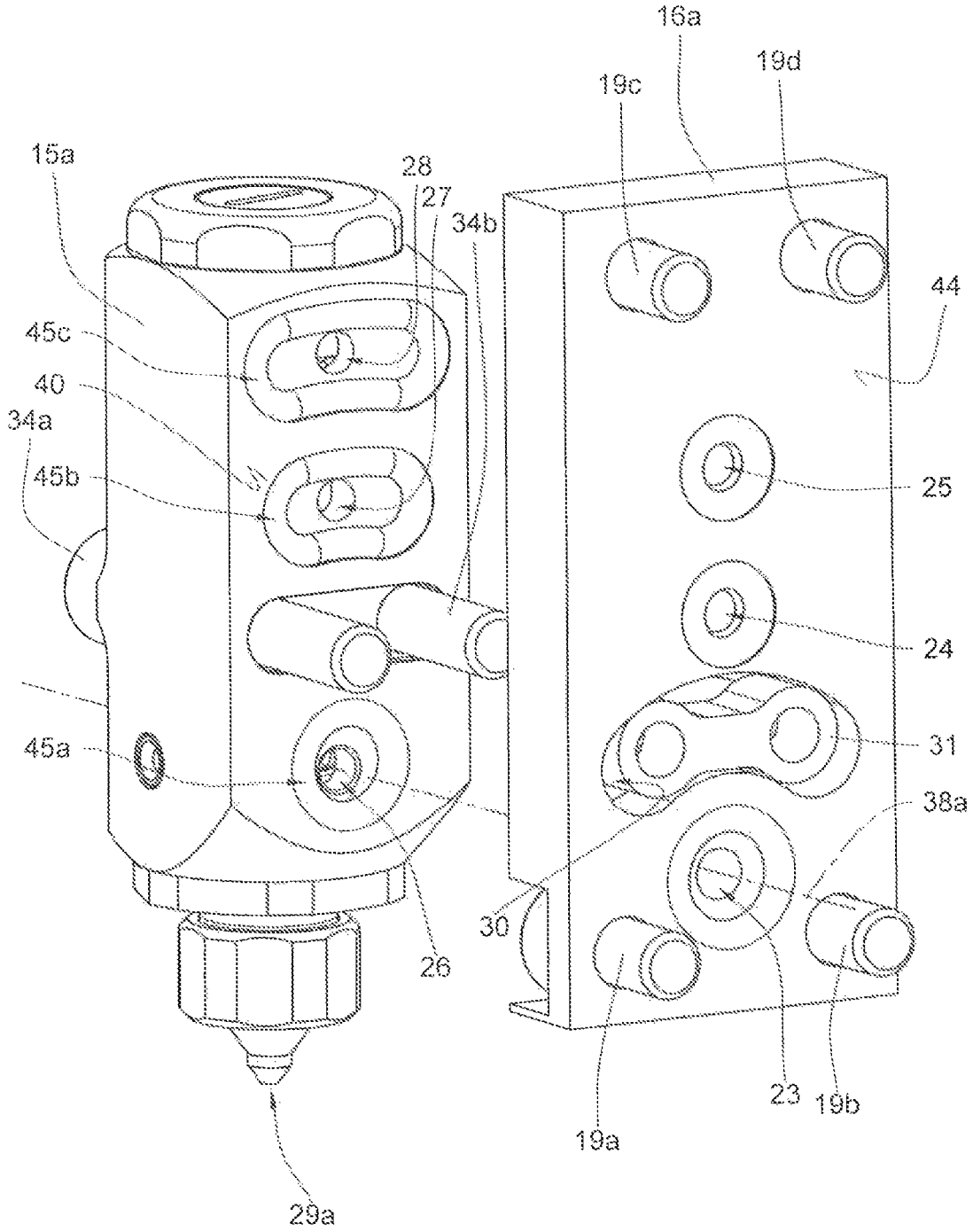
FIG. 5 shows the nozzle head and the adapter plate of FIG. 4 in a perspective view from the rear.
Figure 8:
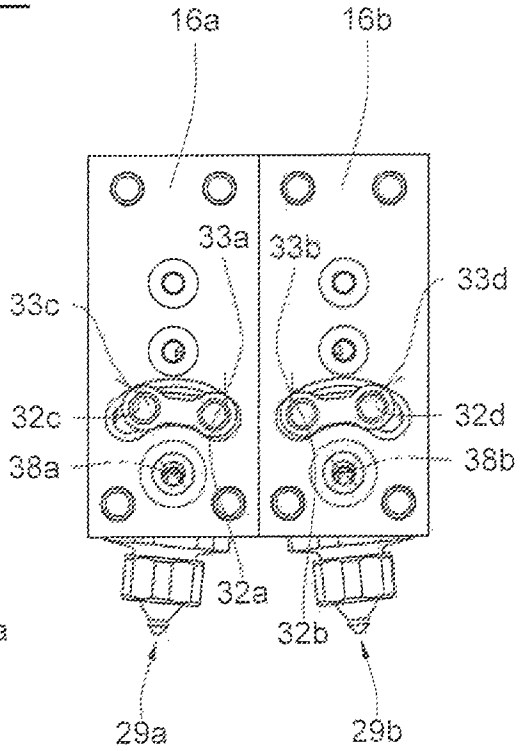
FIG. 8 shows the adapter plates and nozzle heads of FIG. 7 in a view from the rear as per the view arrow VIII in FIG. 7.
Figure 7:
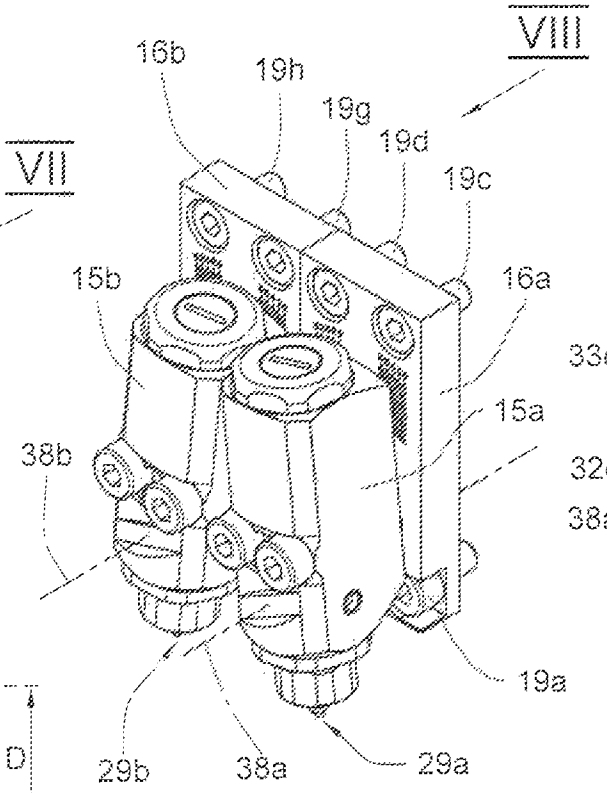
FIG. 7 shows the nozzle heads and the adapter plates of FIG. 6 in a perspective view approximately as per the view arrow VII in FIG. 6.

From a comparison of FIGS. 3 and 5, it is clear that a passage 23 for the fluid, a passage 24 for the first flow fluid and a passage 25 for the second flow fluid are also arranged in the adapter plate 16*a*. When the adapter plate 16*a* is fixedly screwed to the fastening surface 17, the passages 23, 24 and 25 are in each case arranged in alignment with the mouths 20*a*, 21*a* and 22*a*.

It is also pointed out at this juncture that, on its side 40 which faces toward the fastening surface 17, the nozzle head 15*a* has an inlet opening 26 for the fluid, an inlet opening 27 for the first flow fluid and an inlet opening 28 for the second flow fluid, as can be seen most clearly in FIG. 5.

In a position of the nozzle head 15*a* as per FIG. 1, in which the nozzle head 15*a* is aligned parallel to the adapter plate 16*a*, the inlet openings 26, 27 and 28 are arranged in alignment with the passages 23, 24 and 25, and are thus also arranged in alignment with the mouth regions 20*a*, 21*a* and 22*a*.

In the adapter plate 16*a* there is arranged a guide slot 30 which is of arc-shaped form. The arc shape arises from the segment of a circle, the central point of which lies in the region of the central axis 38*a* of the passage 23 for the fluid, that is to say on the pivot axis 38*a*.

A slide block 31 is guided in the guide slot 30. Said slide block 31 has a substantially dumbbell-like or bone-like basic shape, with a constriction in the middle and two rounded ends 32*a*, 32*b*, 32*c*, 32*d* configured to contact the guide slot, for example at 33*a*, 33*b*, 33*c*, 33*d*, respectively. In the region of the rounded ends, the slide block has provided therein receptacles 35*a*, 35*b*, in particular threaded bores, for receiving screws 34*a*, 34*b*. The nozzle head 15*a* can be fastened to the slide block 31 with the aid of the screws 34*a*, 34*b*. Similarly, the nozzle head 15*b* can be fastened to another slide block 31 with the aid of screws 34*c*, 34*d*.

Figure 2:
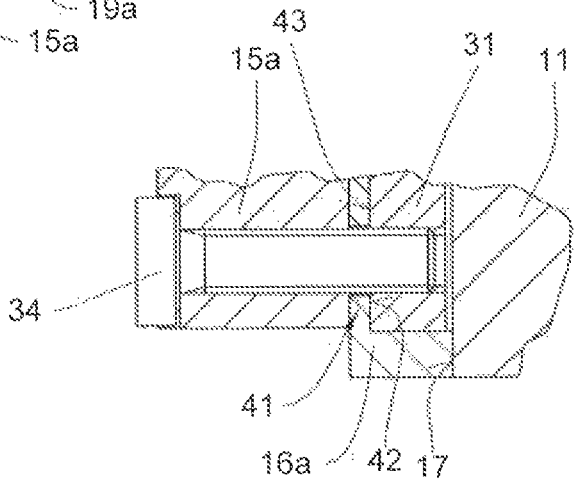
FIG. 2 shows, in a schematic, partially sectional illustration, a section through a connecting region between the nozzle head and adapter plate and supply station, approximately along the section plane labeled II-II in FIG. 1.

As can be seen for example from FIG. 2, the guide slot 30 is provided, on its side facing toward the nozzle head 15*a*, with a constriction 41 which provides a retention surface 42 which faces toward the fastening surface 17. By tightening the screws 34, the slide block 31 can be clamped with its face side 43 against the retention surface 42 (FIG. 2). In this way, the nozzle head 15*a* can be fixedly screwed to the adapter plate 16*a*.

The fastening sequence is as follows: firstly the slide block 31 is inserted into the guide slot 30 from that side of the adapter plate 16 which faces toward the fastening surface 17. The adapter plate 16 is then fixedly screwed to the fastening surface 17 with the aid of the screws 19. The nozzle head 15 can thereafter be fastened relative to the adapter plate by tightening the screws.

To change the pivot position of the nozzle head 15*a*, the screws 34 can be loosened, the desired pivot angle of the nozzle head 15*a* can subsequently be set, and subsequently, when the pivot position of the nozzle head has been selected, the screws 34 can be tightened and the selected pivot angle locked.

It has already been described above that the guide slot 30 runs in the shape of a circular arc around the pivot axis 38*a*. The inlet opening 27 for the first flow fluid and the inlet opening 28 for the second flow fluid on that side 40 of the nozzle head 15 which faces toward the fastening surface 17 are also each provided with an arc-shaped groove or with a groove-shaped widening or with a groove-shaped widening region. The groove is in each case curved along a circular arc whose circle central point coincides with the pivot axis.

All three inlet openings 26, 27 and 28 are in each case surrounded by an annular groove 45*a*, 45*b*, 45*c* which serves for receiving a sealing ring (not illustrated), for example an O ring. More accurately, an O ring is provided only for sealing off the inlet opening 26. Oval, elongate rings (not illustrated) are provided as sealing bodies for the inlet openings 27 and 28, which are of more elongate form, and for the associated grooves 45*b* and 45*c*, which are of more elongate form.

Figure 4:
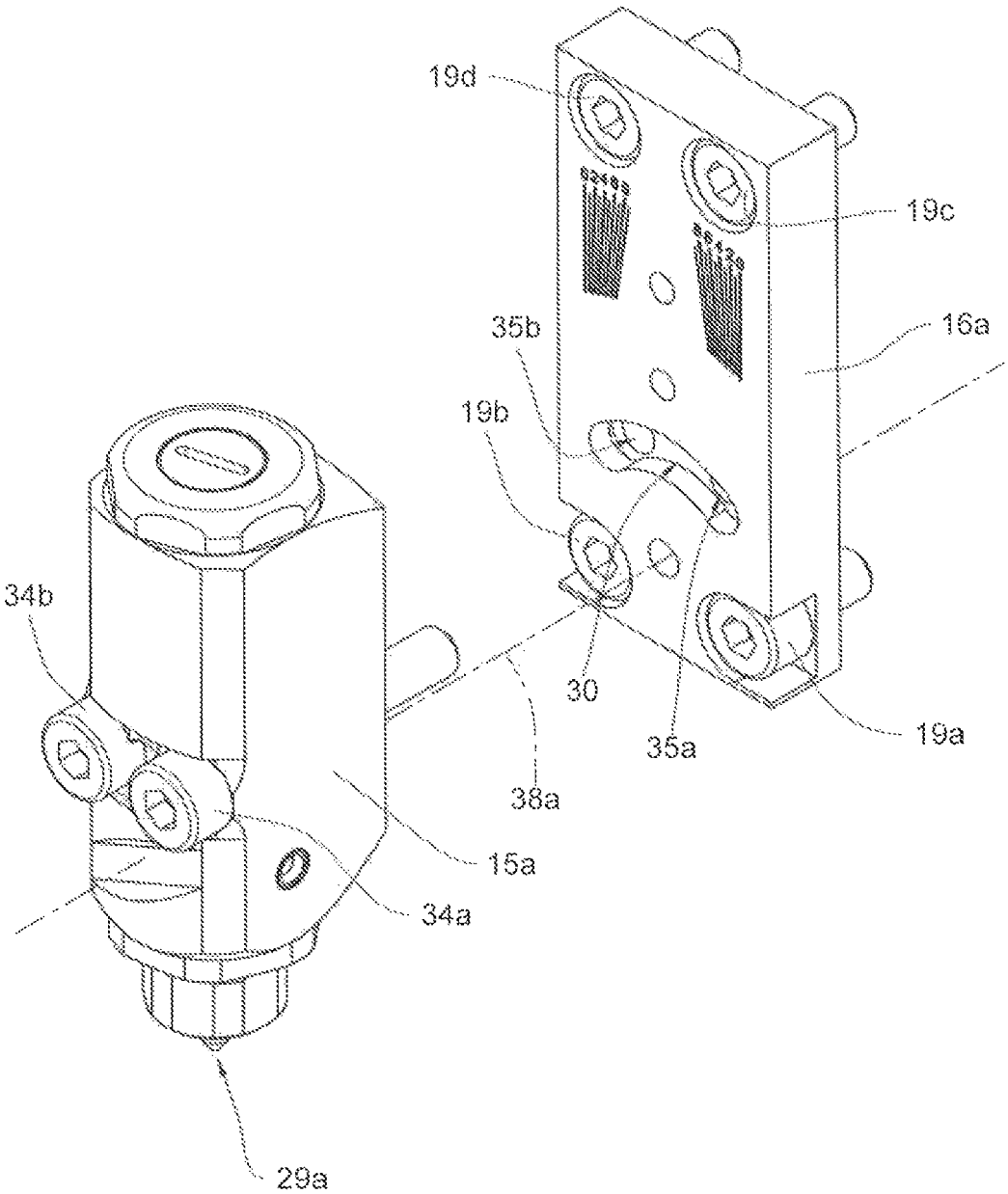
FIG. 4 shows, in a perspective view, a nozzle head and an adapter plate illustrated separate from one another.

Alternatively, that side of the adapter plate which faces toward the nozzle head, and which is not illustrated in FIG. 4, may be provided with corresponding grooves which annularly surround the passages 23, 24, 25 or the mouths thereof.

Finally, correspondingly half-open grooves for receiving sealing rings may be provided both on that side 40 of the nozzle head 15 which faces toward the adapter plate 16, as shown in FIG. 5, and additionally on that side of the adapter plate 16 which faces toward the nozzle head.

A particular advantage of the device according to the invention is that the pivot axis 38*a* about which pivoting of the nozzle head 15 takes place is arranged in the region of the inlet opening 26 for the fluid. In this way, the sealing of the fluid duct 23, in particular the sealing of the mouth region of the passage 23 in the adapter plate 16*a*, can be realized in a particularly reliable and simple manner.

It can furthermore be seen from FIG. 5 that grooves for receiving sealing bodies may likewise be provided, around the passages 23, 24 and 25, on that side 44 of the adapter plate 16 which faces toward the fastening surface 17.

A further exemplary embodiment of a device according to the invention shall now also be described on the basis of FIGS. 12 to 17.

Figure 12:
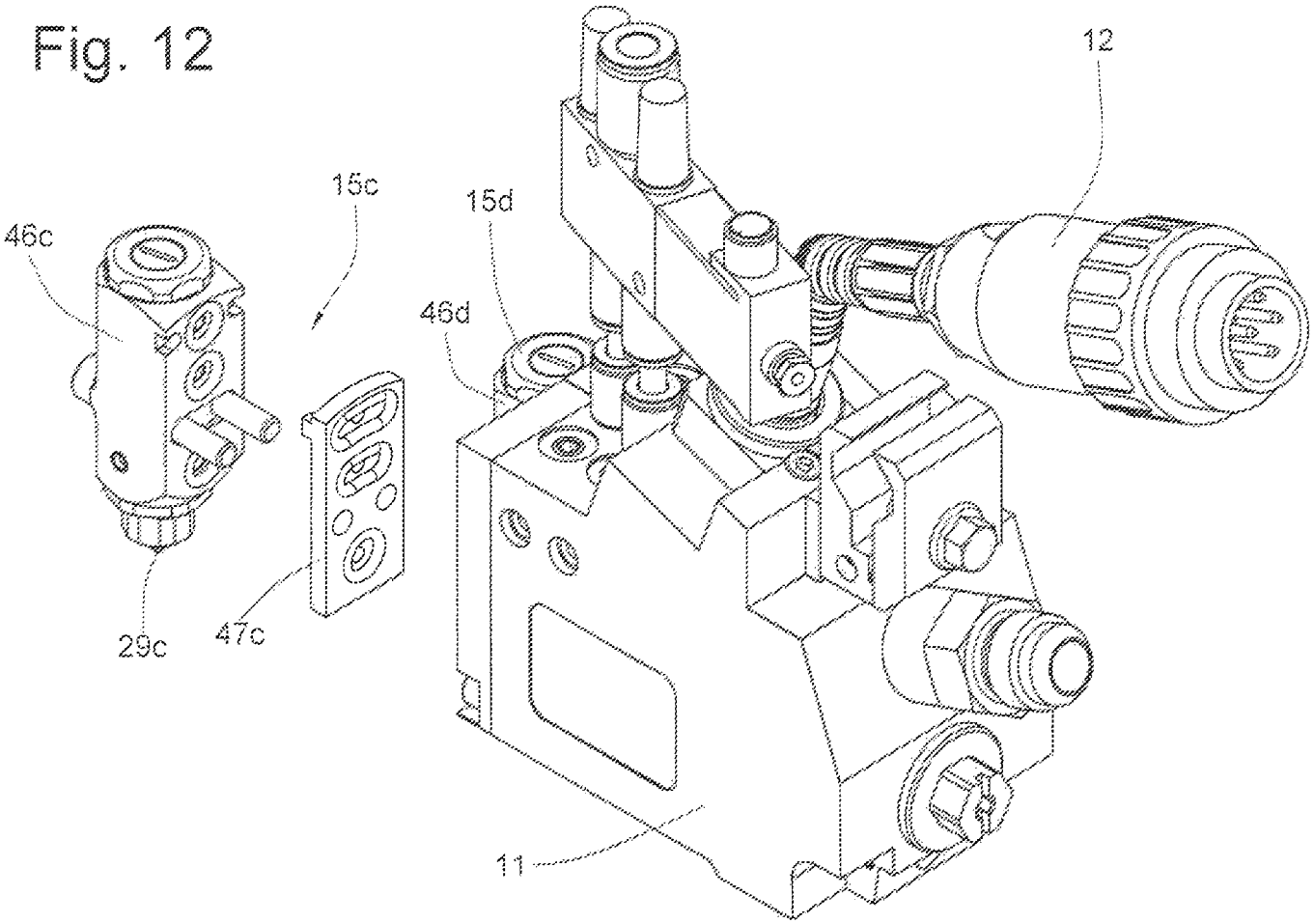
FIG. 12 shows, in a schematic, exploded view from the rear, a further exemplary embodiment of a device according to the invention, which corresponds to the device of FIG. 1 with the special feature that the nozzle head is now provided by two components.

As can be seen from FIG. 12, the nozzle head which is denoted therein by 15*c* is formed in two parts and comprises a first component 46*c* and a second component 47*c*. FIG. 12 does not show that the second nozzle head 15*d* is also formed in two parts. This is however evident from FIGS. 13 and 14, where second nozzle head 15*d* includes first and second components 46*d*, 47*d* and an outlet opening 29*d*.

The nozzle head 15*c* comprises a first component 46*c* which corresponds to a conventional nozzle head of the prior art. From FIG. 17, it can be seen that the first component 46*c* includes an outlet opening 29*c*, and that the inlet side 50 of the nozzle head has an inlet 52 for a fluid, an inlet 53 for a first flow fluid and an inlet 54 for a second flow fluid. In this respect, the arrangement of the three inlets 52, 53 and 54 also corresponds to the positioning of the fluid mouth 20*a*, the mouth 21*a* for the first flow fluid and the mouth 22*a* for the second flow fluid, in each case on the fastening surface 17 of the supply station 11 as per FIG. 3. It would thus be possible for the first component 46*c* to be screwed directly to the fastening surface 17 of the supply station 11. Under these conditions, however, the first component 46*c*, which in this case would directly provide a nozzle head, would not be used within the meaning of the invention.

Figure 16:
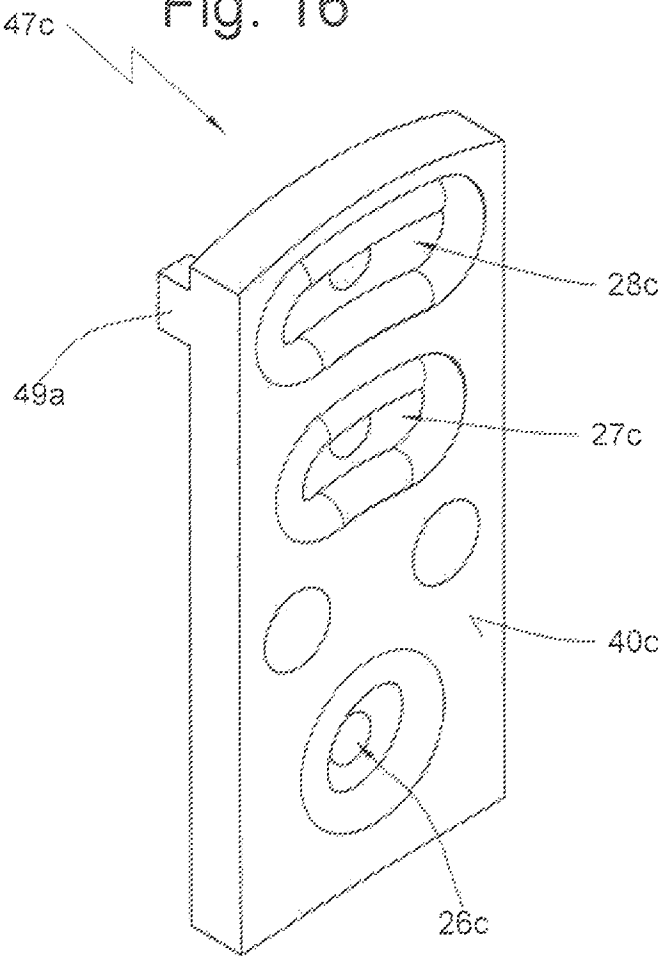
FIG. 16 shows the second component as per FIG. 15 in a view from the front.
Figure 15:
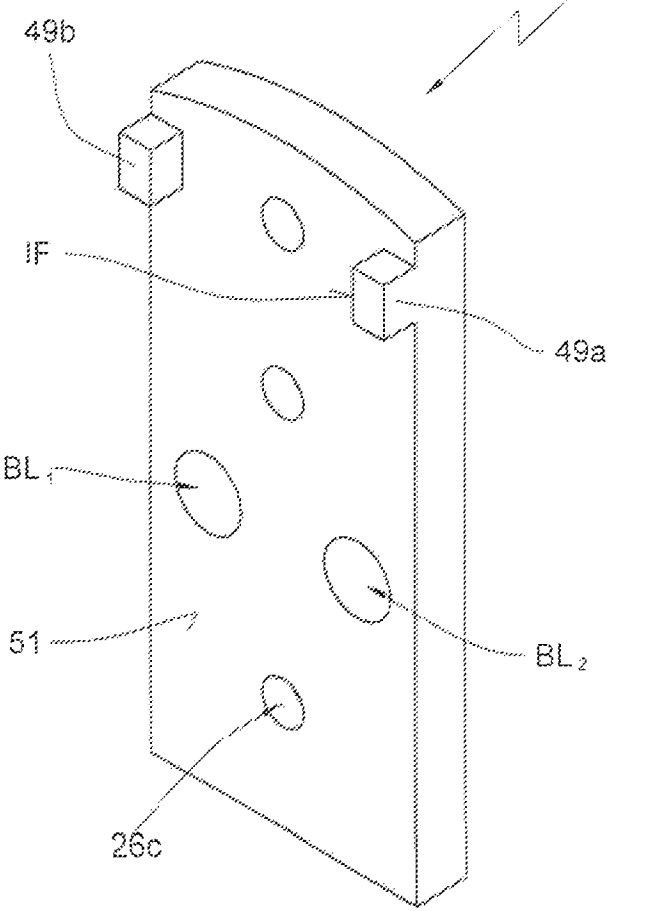
FIG. 15 shows a detail illustration of the second component, in a view from the rear.

To allow the first component 46*c* to be used within the meaning of the invention, a second component 47*c* is provided which shall be described on the basis of FIGS. 15 and 16. The second component 47*c* has an outlet side 51 which is kept substantially smooth and which, in the mounted state of the components 46*c*, 47*c*, bears against the inlet side 50 of the first component 46*c*.

Furthermore, the second component 47*c* has an inlet side 40*c* which substantially corresponds to the inlet side 40 of the nozzle head 15*a* of the exemplary embodiment of FIG. 5.

On the inlet side 40*c* of the second component 47*c* there is arranged a fluid inlet 26*c*, an inlet 27*c* for a first flow fluid and an inlet 28*c* for a second flow fluid. The inlet openings 27*c*, 28*c* have a circular-arc-shaped widening which extends along a radius around the pivot axis 38 or around the central axis of the inlet opening 26*c*.

On the second component 47*c* there are arranged projections 49*a*, 49*b* which can be inserted complementarily into corresponding recesses 48*a*, 48*b* (cf. FIG. 17) on the inlet side 50 of the first component 46*c*. In this respect, the recesses 48*a*, 48*b* of the first component 46*c* form positioning means, and the projections 49*a*, 49*b* on the second component 47*c* form corresponding counterpart positioning means. Through interaction of the positioning means and counterpart positioning means, it is possible to ensure precise and correct positioning of the components 46*c*, 47*c* relative to one another.

Figure 17:
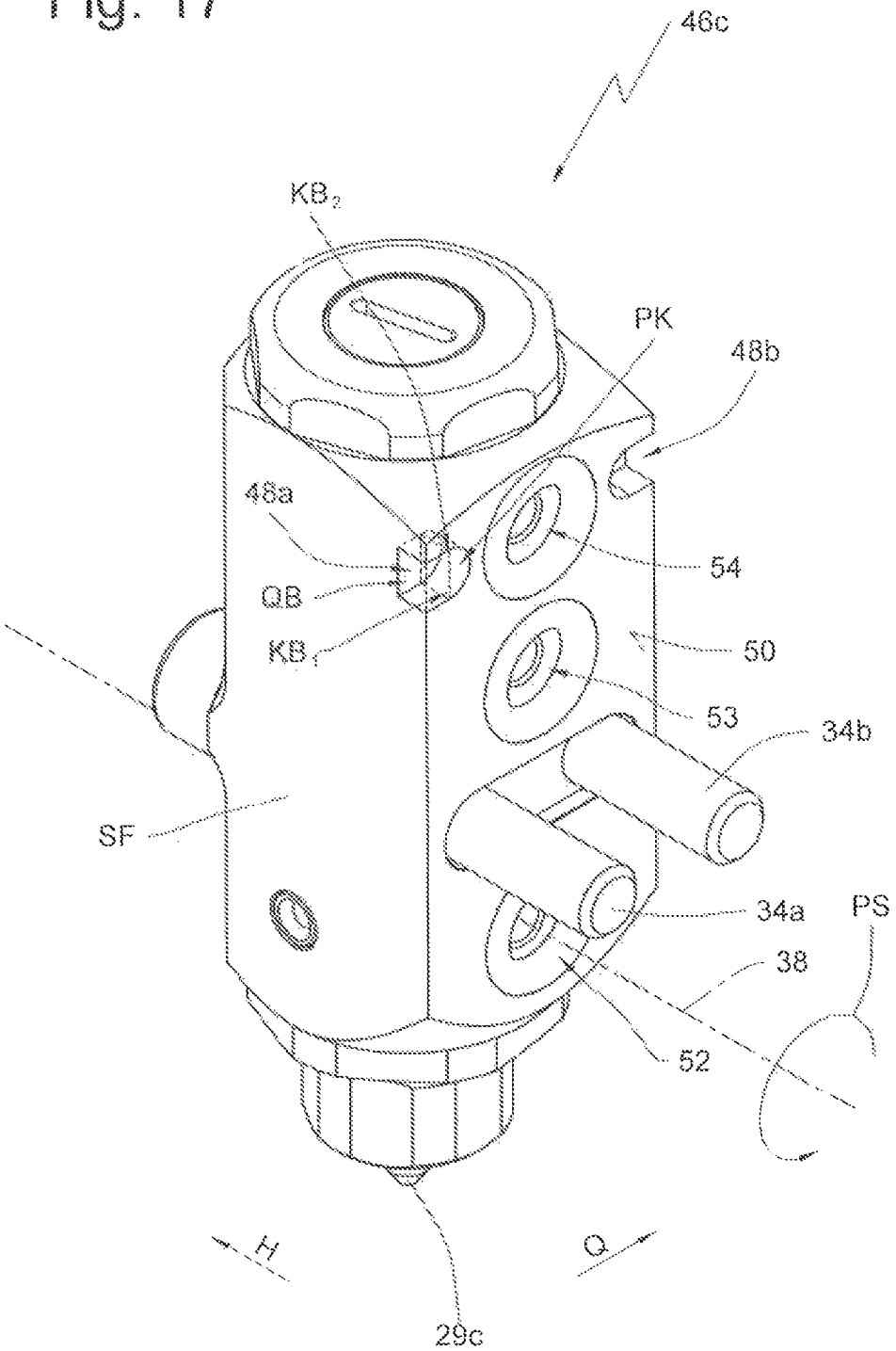
FIG. 17 shows the first component in a view from the rear.

FIG. 17 shows that the two recesses 48*a*, 48*b* are formed in each case as edge recesses. Each edge recess 48*a*, 48*b* extends from the inlet side 50 in the direction H. The two edge recesses 48*a*, 48*b* furthermore extend from the respective side surface SF of the module inward, that is to say toward the center of the module.

For example, the edge recess 48*a* as per FIG. 17 extends from the side surface SF of the module in the transverse direction Q.

The edge recess 48*a* has been formed for example by virtue of the block-shaped material of the first component 46*c*, or nozzle head, being milled out, wherein a corresponding rotating milling head moves toward the side surface SF and is then moved continuously onward in the direction Q. The edge recess 48*a* thus attained has a cuboidal region QB and a plano-convex region PK which is generated during the course of the milling process.

The cuboidal region QB is dimensioned to be so large that the male projections 49*a*, 49*b* which are arranged on the outlet side of the second component 47*c*, or adapter plate, as can be seen from FIG. 15, can be received completely in said cuboidal region.

If, proceeding from a position as per FIG. 17, the module is pivoted about the pivot axis 38 in FIG. 17 in the direction of the arrow PS by the exertion of manual force on the first component 46*c*, a contact region KB1 and a second contact region KB2 come into contact with the inner flank IF (FIG. 15) of the complementary male projection 49*a*, and ensures reliable, play-free or virtually play-free rotary driving of the second component 47*c*, the so-called adapter plate, as per FIG. 15.

In this respect, rotary driving as a result of the contact need not be realized by means of the drilled holes denoted by BL1 and BL2 in FIG. 15, which may accordingly have an inner diameter larger than the outer diameter of the fastening screws 34*a*, 34*b*.

Since the recesses 48*a*, 48*b* are arranged far remote from the inlet opening 52 for the fluid, and therefore also far remote from the pivot axis 38, a particularly advantageous distribution of force or a particularly efficient engagement of force is attained. In this way, optimum rotational locking of the first component 46*c* and second component 47*c* during the pivoting movement is attained.

The symmetrical formation and symmetrical arrangement of the two recesses 48*a*, 48*b* in relation to the inlet 54 for the second flow fluid furthermore serves to ensure the desired play-free or virtually play-free rotationally conjoint action in both directions of rotation.

Figure 13:
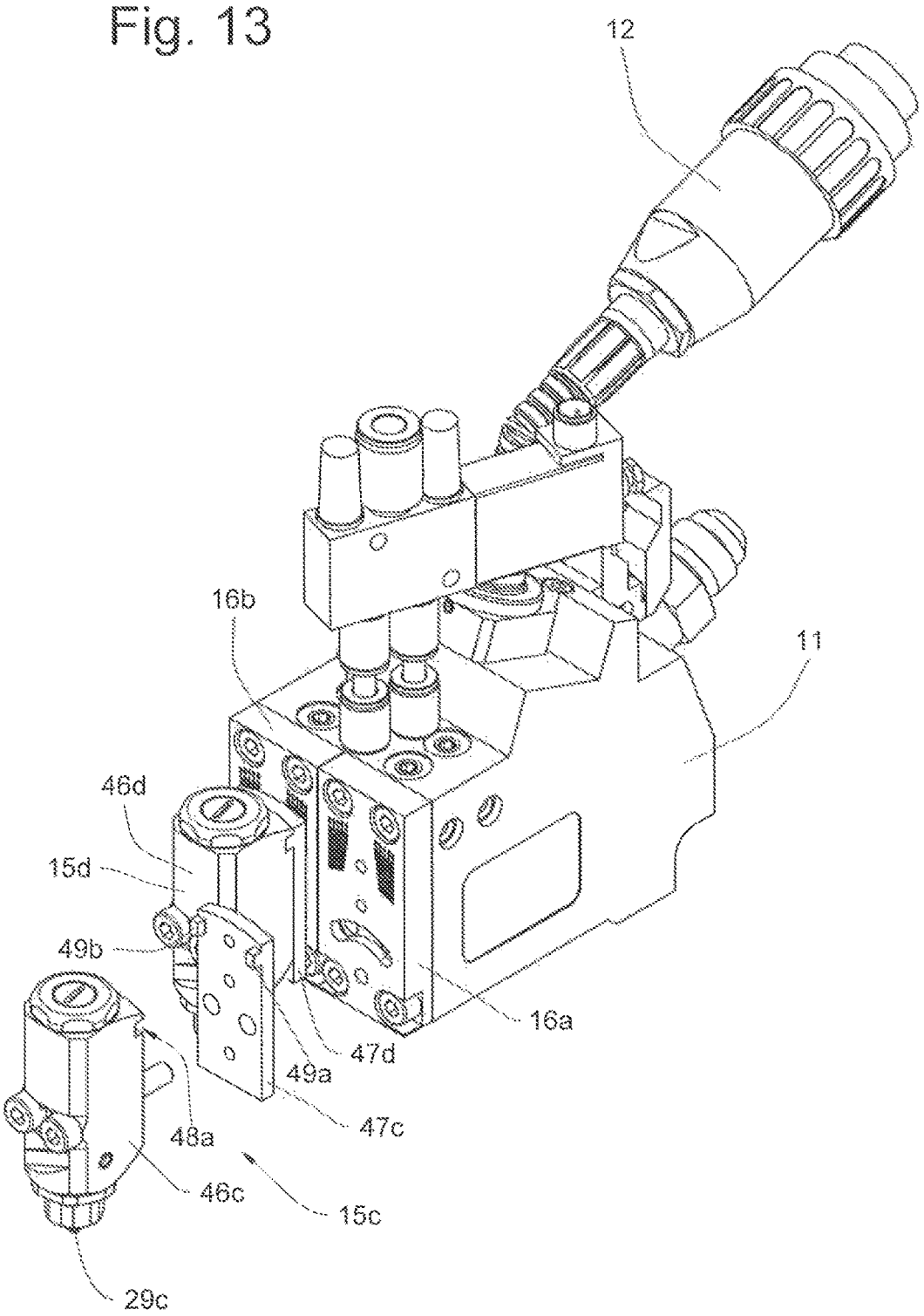
FIG. 13 shows the device of FIG. 12 in an illustration as per FIG. 1, wherein the nozzle head which is arranged in the mounted state on the right in FIG. 12 and which comprises two components is shown in an exploded illustration.
Figure 14:
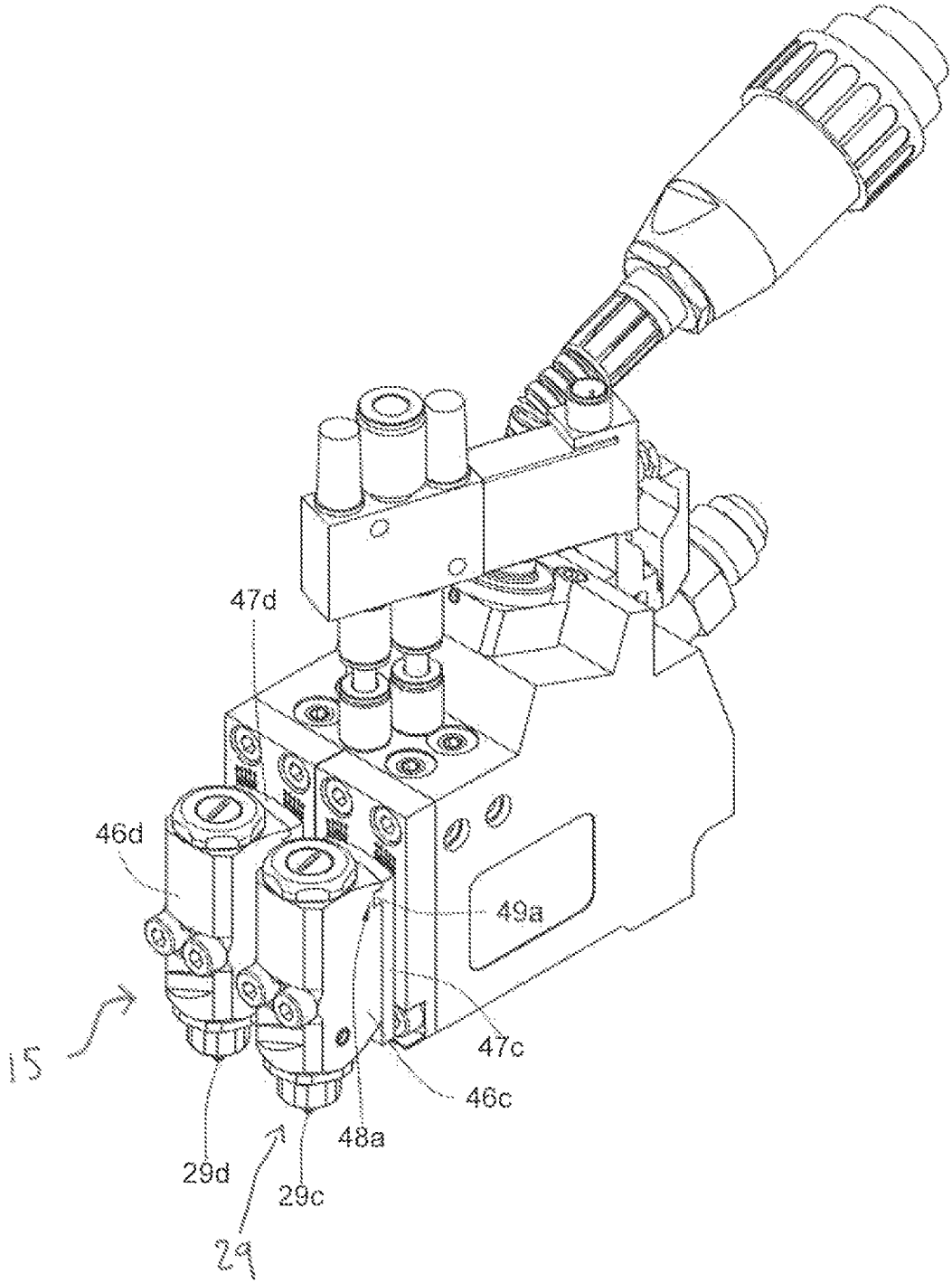
FIG. 14 shows the device of FIG. 13 in an assembled state in an illustration as per FIG. 1.

The second component 47*c* has bores through which the screws 34*a*, 34*b*, which are held on the first component 46*c*, can extend, such that a fastening of the nozzle head 15*c* which is composed of two components 46*c*, 47*c* can take place with the aid of an adapter plate 16*a*, as illustrated in the exemplary embodiment of FIG. 13 and also in the exemplary embodiment of FIG. 1. The invention also encompasses exemplary embodiments in which nozzle heads which comprise components 46*c*, 47*c* can be fastened directly to a fastening surface 17 of a supply station 11 without the aid of such an adapter plate, if the inventive principle specified in the independent claims is used.

The invention claimed is:

1. A device for applying a fluid to a moving substrate, the device comprising a nozzle head with an inlet opening for the fluid and with an outlet opening for the fluid and comprising a supply station with a fastening surface with a mouth region of a fluid duct and a groove extending along an arc, the nozzle head being arranged so as to be pivotable relative to the fastening surface about a pivot axis, wherein the inlet opening for the fluid and the mouth region of the fluid duct are arranged in alignment along the pivot axis, and wherein the nozzle head has a screw projecting from a rear surface and received in the groove, the screw movable within the groove during pivoting movement of the nozzle head.

2. The device as claimed in claim 1, wherein a mouth region of a first flow fluid duct in the fastening surface is communicatively connected to an inlet opening for the first flow fluid on a side, which faces toward the fastening surface, of the nozzle head, and wherein the inlet opening for the first flow fluid is formed so as to be curved along a circular arc around the pivot axis.

3. The device as claimed in claim 2, wherein a mouth region of a second flow fluid duct in the fastening surface is communicatively connected to an inlet opening for the second flow fluid on a side, which faces toward the fastening surface, of the nozzle head, and wherein the inlet opening for the second flow fluid is curved along a circular arc around the pivot axis.

4. The device as claimed in claim 2, wherein the inlet opening for the fluid and/or the at least one inlet opening for the first or second flow fluid is surrounded by an annular groove which provides a receptacle for a sealing ring.

5. The device as claimed in claim 1, wherein the nozzle head comprises two components, the outlet opening for the fluid on the nozzle head being provided by a first component, and the inlet opening for the fluid on the nozzle head being provided by a second component.

6. The device as claimed in claim 5, wherein the second component can be detachably fastened to the first component or wherein the second component can be detachably mounted on the first component.

7. The device as claimed in claim 5, wherein, on the first component, there are arranged coding means or positioning means which cooperate with complementary counterpart coding means or counterpart positioning means arranged on the second component.

8. The device as claimed in claim 5, wherein the first component is provided in the form of an in particular conventional nozzle head, and has an inlet side which faces toward an outlet side of the second component.

9. The device as claimed in claim 5, wherein a mouth region of a first flow fluid duct in the fastening surface is communicatively connected to an inlet opening for the first flow fluid on a side, which faces toward the fastening surface, of the second component, and wherein the inlet opening for the first flow fluid is formed so as to be curved along a circular arc around the pivot axis.

10. The device as claimed in claim 5, wherein a mouth region of a second flow fluid duct in the fastening surface is communicatively connected to an inlet opening for the second flow fluid on a side, which faces toward the fastening surface, of the second component, and wherein the inlet opening for the second flow fluid is curved along a circular arc around the pivot axis.

11. A device for applying a fluid to a moving substrate, the device comprising a nozzle head with an outlet opening for the fluid and comprising a supply station with a fastening surface and with a mouth region of a fluid duct arranged on the fastening surface, the nozzle head being arranged so as to be pivotable relative to the fastening surface about a pivot axis, wherein the nozzle head is fastened to the fastening surface with the aid of an adapter plate, a groove extending through the adapter plate, the groove curved along a circular arc, the pivot axis running through the central point of the circular arc, and wherein the nozzle head has a screw projecting from a rear surface and received in the groove, the screw movable within the groove during pivoting movement of the nozzle head.

12. The device as claimed in claim 11, wherein a slide block is guided in the groove and the screw is received in the slide block.

13. The device as claimed in claim 12, wherein the slide block is displaceable between two stop positions.

14. The device as claimed in claim 12, wherein the slide block has a dumbbell shape.

15. The device as claimed in claim 12, wherein the slide block has screw receptacles, in particular threaded bores, on its side facing toward the nozzle head.

16. The device as claimed in claim 12, wherein the groove has, on its side facing towards the nozzle head, a constriction with a retention surface which faces towards the fastening surface and against which the slide block can be clamped.

* * * * *